United States Patent [19]

Peterson

[11] 4,286,447

[45] Sep. 1, 1981

[54] METHOD AND APPARATUS FOR AUTOMATIC GAUGE CONTROL SYSTEM FOR TANDEM ROLLING MILLS

[75] Inventor: Robert S. Peterson, Williamsville, N.Y.

[73] Assignee: Westinghouse Electric Corp., Pittsburgh, Pa.

[21] Appl. No.: 19,530

[22] Filed: Mar. 12, 1979

[51] Int. Cl.[3] ..... B21B 37/06

[52] U.S. Cl. ..... 72/9; 72/16; 72/17

[58] Field of Search ..... 72/6–9, 72/11, 16, 17, 19; 29/205, 121.8

[56] References Cited

U.S. PATENT DOCUMENTS

| | | | |
|---|---|---|---|
| 1,932,168 | 10/1933 | Adams | 29/121.8 |
| 3,440,846 | 4/1969 | Scott | 72/11 |
| 3,531,961 | 10/1970 | Dunn | 72/8 |
| 3,740,983 | 6/1973 | Peterson | 72/16 |
| 3,765,203 | 10/1973 | Peterson | 72/9 |
| 3,768,286 | 10/1973 | Peterson | 72/9 |
| 3,782,151 | 1/1974 | Peterson | 72/9 |

*Primary Examiner*—Milton S. Mehr
*Attorney, Agent, or Firm*—C. M. Lorin

[57] ABSTRACT

Method and apparatus are disclosed for controlling the final output gauge of strip material passing through a tandem rolling mill in which the final reduction in gauge is substantially accomplished at the next to the last stand. An automatic gauge control (AGC) loop responsive to the changes in speed of the next to the last stand, controls the speed regulators for the last two stands. Responsive to the next to the last stand speed, the AGC loop provides a variable gain at low and high mill speeds respectively to appropriately adjust the control signals to the speed regulators for the last two stands. Interstand tension control between the last two stands is provided by modification of the speed regulator for the last stand.

3 Claims, 5 Drawing Figures

METHOD AND APPARATUS FOR AUTOMATIC GAUGE CONTROL SYSTEM FOR TANDEM ROLLING MILLS

BACKGROUND OF THE INVENTION

1. Field of the Invention

This invention relates to an automatic gauge control (AGC) for tandem rolling mills.

2. Description of the Prior Art

In processing strip material, such as tin for example, the product is successively reduced in thickness in tandem rolling mills, a high reduction in gauge being accomplished at the last stand of the series. The term high reduction here means a relatively large change in gauge of the strip material entering the last stand vis-a-vis the gauge of the material leaving the last stand. Such a process line is described in U.S. Pat. No. 3,740,983 for an "Automatic Gauge Control System for Tandem Rolling Mills", invented by Robert S. Peterson and John W. Cook. In the system described in this patent, the final output gauge is obtained by using AGC on the last stand to change the speed of the last stand, which then results in a change in tension in the strip material between the next to last, and the last stands. This inter-stand tension is then adjusted back to some preselected reference tension by displacement of the screw down setting for the last stand, thereby changing the roll gap setting of the last stand to that of the desired strip delivery gauge.

A special environment occurs in multistand cold mills where the finished product being rolled requires a roughened surface. Typically, such a situation arises where the final sheet product must be capable of supporting for example a coating of paint or zinc as is required in the production of galvanized sheet. In these situations the last stand of the tandem mill is customarily provided with sand blasted rolls. Contrary to usual tin mill operation, in mills such as this, very little strip reduction is accomplished by the sand blasted rolls of the last stand; typically this reduction is in the order of only 3%, so that screw down control for the last stand is not included as part of the AGC (the operator may be provided with optional manual means for screw down adjustment for the last stand, but this is not a part of the automatic gauge control (AGC)).

In any rolling operation where the objective is to control the gauge of the finished product, some kind of tension regulators are provided between all the stands. In the situation where screw down control is not permitted at the last stand, then tension is regulated by controlling the speed of the last stand. Such a system is described in U.S. Pat. No. 3,765,203 for "Automatic Gauge Control by Tension for Tandem Rolling Mills" invented by Robert S. Peterson. However, in using the teachings of this patent for rolling thin galvinized sheet (in the order of 10–25 mils thick), considerable difficulties were encountered, such as tearing of the galvanized sheet, with inevitable losses in production. Although it is axiomatic, it bears repeating, that when AGC is accomplished by tension control using speed adjustment between the last two stands, when there is a change in speed there is an interrelated change in tension. This requires a trade-off because there are limits to the permissible excursions for the tension parameter. If the mill were perfect, the operator would be given a tension reference to run the mill and that could produce the correct delivered gauge. Such a perfect mill does not exist in a real world, and hence, the operator is given permissible ranges for the changes in tension, for example +60%, −40%, i.e. the tension can increase 60% higher than the tension reference or decrease to 40% of the tension reference.

When rolling thick sheet, the increase in tension range can be tolerated fairly well, but the decrease in tension is troublesome. However, when rolling thin sheet i.e. in the order 10–25 mils, both the increases as well as the decreases in tension range are troublesome. When the tension increases too much, the thin sheet may be pulled apart. When the tension decreases there must be a trade off between roll force and tension. When tension is decreased, the roll force goes up. If the decrease in tension is of sufficient magnitude, the roll force will increase to the point where the rolls actually come down on the sheet product. This is known as a "pinch out", and again the sheet will be pulled apart.

If the teachings of U.S. Pat. No. 3,765,203 cited supra were applied to this situation, the AGC on the last stand saturates. In order to solve this the prior art teaches the utilization of range control to bring the AGC out of saturation; this can be accomplished by changing the speed of next to the last stand, but the required changes in speed are not necessarily in such direction as to provide the desired delivery gauge at the last stand, with the result that the delivered product tends to run off-gauge.

In this special rolling situation i.e. rolling thin galvanized sheet; the specifications for the finished rolled product, viz; a roughened surface, require that sand blasted rolls be utilized on the last stand of the tandem mill, with the result that prior art delivery (last stand) AGC using tension control by speed change, produces adverse effects which are cumulative, making this technique a non-workable solution. It has been empirically determined that a 3% reduction in product is all that can be accomplished at the last stand. If a greater swing in tension excursion is attempted, (resulting in greater than 3% reduction) then if the sheet does not tear first, then the sand blast coating is worn away or the rolls overheat. (This does not happen with the thicker product so wider tension excursion is possible.) The fact that sand blasted rolls are mandatory for this operation means that only a small or nominal reduction in gauge can be realized at the last stand. The concomitant effect is that this increases the tension excursion between the last two stands so that there is a practical limit on the permissible reduction in delivered gauge. Stated differently, even for only a 1% reduction in gauge at the last stand, there is a limit on the permissible swing in tension between the last two stands, because if the tension were permitted to fall too low, the roll force would go up, and the change in roll gap for the last stand could be large enough to cause the rolls to pinch—this would be catastrophic since it would result in a mill wreck. Generally speaking the screws on the last stand of a sheet mill (i.e. the last stand has sand blasted rolls) are not displaced.

SUMMARY OF THE INVENTION

Method and apparatus are claimed for controlling the final output gauge of strip material passing through a tandem rolling mill of 1, 2, 3 . . . n stands, in which the final reduction gauge is substantially accomplished at the $(n-1)^{th}$ stand. An automatic gauge control (AGC) loop, responsive to deviations from said final reduction gauge and to changes in speed of the $(n-1)^{th}$ stand, controls the speed regulators for the $(n-1)^{th}$ and the $n^{th}$ stands. Responsive to the $(n-1)^{th}$ stand speed, the AGC loop provides different gains at low and high mill speeds respectively, to appropriately adjust the control signals to the $(n-1)^{th}$ and $n^{th}$ speed regulators. Interstand tension control between the last two stands is provided by modification of the control input to the speed regulator for the $n^{th}$ stand.

DESCRIPTION OF THE PREFERRED EMBODIMENT

Figure 1:
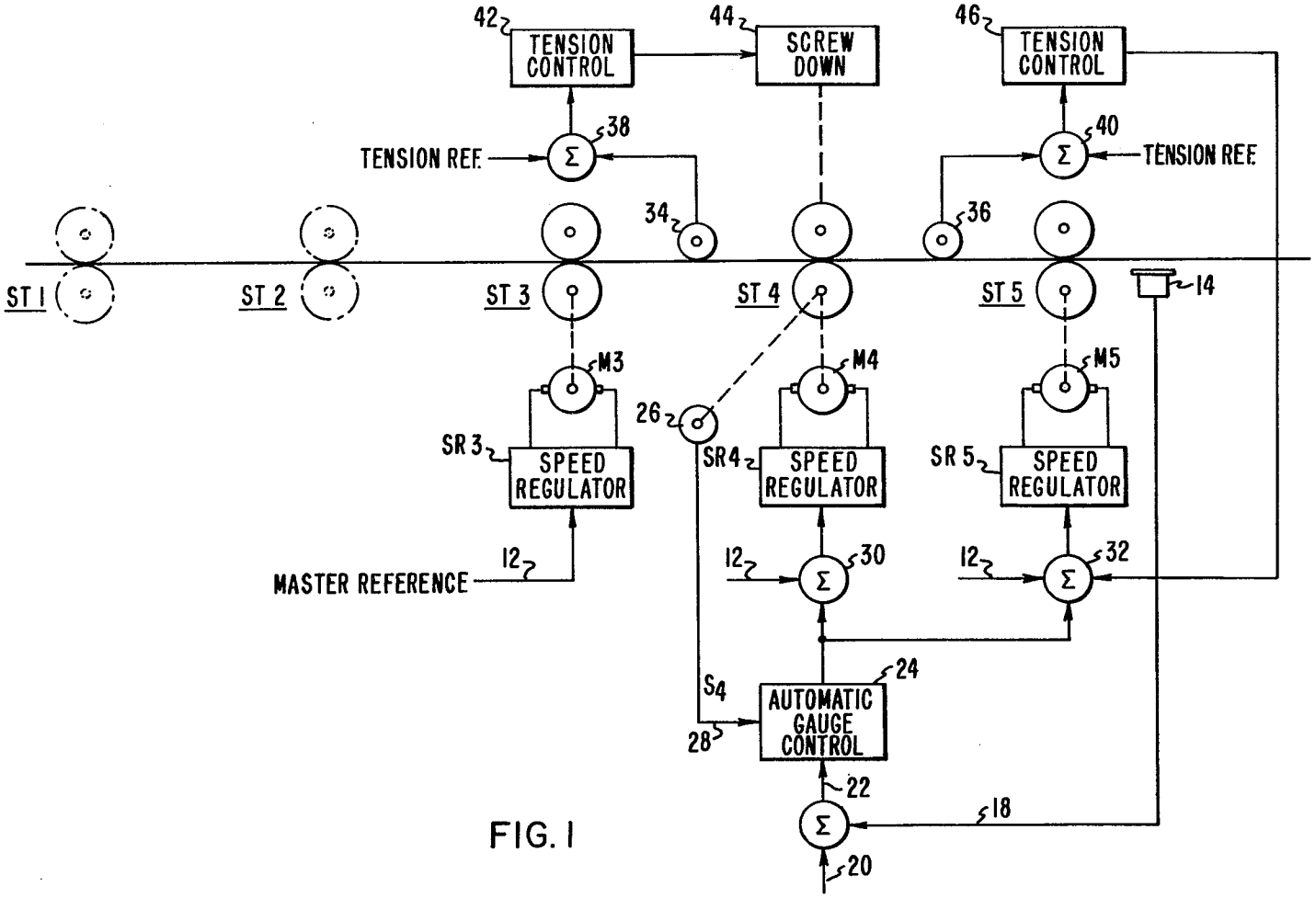
FIG. 1 is a schematic block diagram of a tandem rolling mill utilizing the automatic gauge control system in accordance with the instant invention.

Referring now to FIG. 1 of the drawing, there is shown a tandem rolling mill having a plurality of stands 1, 2, 3 . . . n, here illustrated with five stands which are further particularized as: ST1, ST2, ST3, ST4 and ST5. As will presently be made clear, the invention is concerned primarily with stands 3, 4 and 5 i.e. ST3, ST4 and ST5 and hence, these are shown full line, while the first two i.e. stands ST1 and ST2 are in phantom outline.

The sheet material 10 to be processed is passed successively through the mill stands ST1 . . . ST5, each stand progressively reducing the material in the thickness dimension, toward delivery gauge at the exit to stand ST5. In the processing of galvanized sheet or where the finished material is to be coated (with paint for example), the last stand, in the illustrative embodiment here described ST5, includes rolls which are sandblasted so that as a practical matter most of the reduction in thickness is accomplished by the time the material leaves stand ST4.

The rolls are energized by electric motors only three of which are shown in the interest of brevity: M3, M4 and M5; these motors are controlled by speed regulators SR3, SR4 and SR5 respectively. The speed regulators receive a master speed reference on lead 12 from a master mill speed control (not shown). The master speed reference (unless modified as in the case of stands SR4 and SR5) determines the speed of the associated motor.

As the sheet material exits from the last stand ST5, it is measured for thickness by an x-ray gauge shown symbolically at 14, and the resulting voltage signal which is a function of sheet thickness, is sent to summation point 16 via lead 18. A second input to the summation point 16 is a gauge reference signal on lead 20. The gauge reference signal, which is a function of the desired or output gauge, is fed in manually by the mill operator from his console, or is sent automatically by computer, and is then algebraically summed with the actual thickness gauge signal on lead 18 to provide an error output signal 22 calibrated in volts/percent which is then fed to the stand ST4 ST5 automatic gauge control (AGC) 24. The AGC circuit 24 will be described later in the description of FIGS. 1, 2, 3, and 4.

A tachometer or pulse generator 26 coupled to stand ST4, develops a voltage signal which is proportional to the rotational speed of stand ST4; this signal is applied to the AGC 24 on lead 28. The output of AGC 24 is then summed with the master speed reference 12 at summation points 30 and 32, and then applied to speed regulators SR4 and SR5 respectively to control these stand speeds together in response to gauge errors thereby limiting the variation in ST5 speed for the purpose of controlling tension. A tensiometer 34, in engagement with the material 10, derives a signal which is a function of the actual tension of the material between stands ST3 and ST4. Similarly tensiometer 36 in engagement with the material 10, provides a signal representative of the actual tension in the material between stands ST4 and ST5. These actual tension signals are summed with respective tension references at summation points 38 and 40 respectively as shown.

At summation point 38 the actual tension signal is compared with a tension reference signal, and if there is a difference, an error signal is sent to tension control circuit 42, the output of which is applied to screw down mechanism 44 which adjusts the gap between the rollers of stand S4 until the actual tension reaches the desired tension. (The tension control 42 includes a predetermined dead band, so that adjustments in the screw down mechanism 44 are made only when the tension becomes too low or too high in accordance with these predetermined limits).

At summation point 40, the actual tension signal is compared with a tension reference signal and if there is a difference an error signal is sent to tension control circuit 46 the output of which is applied to summation point 32. The tension control circuit 46 maintains tension between stands ST4 and ST5 by speed control as taught in U.S. Pat. No. 3,768,286 for "Interstand Tension Regulator For A Multistand Rolling Mill" invented by Robert S. Peterson and assigned to the same assignee as the present invention.

As is well known, a constant volume of strip material per unit of time enters and leaves the rolling mill and each stand of that mill. Let $T_1$=the strip gauge in mils where the stand index equals 1, 2, . . . 5 to identify the stand, and let Si=the stand speed in feet per second where i again=1, 2, . . . 5 to identify the stand. The constant volume principle is expressed mathematically:

$$T_1S_1=T_2S_2=T_3S_3=T_4S_4=T_5S_5=\text{Constant } Km \quad (1)$$

Selecting the relationship $T_5S_5=Km$ and solving for the delivery gauge $T_5$ as a function of mill speed $S_5$:

$$T_5=Km/S_5 \quad (2)$$

Equation (2), relating the strip thickness $T_5$ and the last stand speed $S_5$ is essentially a non-linear relationship, but it can be linearized around an operating point where the last stand speed $S_5=S_0$ and the delivery gauge $T_5=T_0$.

For small perturbations of stand speed $S_5$, this linearized equation represents the linear transfer function relating the delivery gauge $\Delta T_5$ to the speed $\Delta S_5$. Let $K_g$=the gain constant between $T_5$ and $S_5$.

$$K_g = \frac{\alpha T_5}{\alpha S_5}\bigg|_{S_5 = S_0} \quad (3)$$

From equation (2) $T_5 = Km/S_5$ $$K_g = \frac{\alpha\left(\frac{Km}{S_5}\right)}{\alpha S_5}\bigg|_{S_5 = S_0} = -\frac{Km}{(S_5)^2}\bigg|_{S_5 = S_0} = -\frac{Km}{(S_0)^2} \quad (4)$$

By definition $$Km = T_5 S_5 = T_0 S_0 \quad (5)$$

Substituting equation (5) into equation (4):

$$K_g = -\frac{Km}{(S_0)^2} = -\frac{T_0}{S_0} \quad (6)$$

From perturbation theory $$\Delta T_5 = \left[\frac{\alpha T_5}{\alpha S_5}\bigg|_{S_5 = S_0}\right]_{T_5 = T_0} \Delta S_5 \quad (7)$$

and $$\Delta T_5 = -\left(\frac{T_0}{S_0}\right)\Delta S_5 \text{ (STAND 5)} \quad (8)$$

Equation (8) represents the linear transfer function relating delivery gauge $T_5$ to stand 5 speed $S_5$ which is the fixed plant of the control system. In order to maintain a constant automatic gain control (AGC) loop response, with change in mill product, it is required that the AGC controller gain be multiplied by the stand 5 speed i.e. $S_0$ and divided by the strip delivery thickness $T_0$. If a volts/percentage x-ray gauge error signal is used, the AGC controller and gauge sensor combination gain is divided by the strip delivery thickness. Multiplication of the AGC controller gain by stand 5 speed $S_0$ will compensate for changes in stand 5 speed.

Since very little strip reduction is made in stand 5 for all practical purposes, the speed of stand 5 is substantially equal to that of stand 4 and equation (8) may be written for stand 4 as:

$$\Delta T_5 = -\left(\frac{T_0}{S_0}\right)\Delta S_4 \text{ (STAND 4)} \quad (9)$$

Where $S_0$ is the operating speed of stand 4. Transport time is defined as the time required for the strip to travel between the bite of the rolls and the location of the delivery thickness gauge 14. In rolling tin plate, the major reduction in thickness takes place at the last stand n, but in the environment of the present invention, the major reduction takes place at the next to the last stand $(n-1)^{th}$, so that the transport time is now the time it takes the material to enter the bite of stand $(n-1)$ until it reaches the thickness gauge 14.

The transport time delay between the location of the delivery gauge, and the next to the last stand $(n-1)$ is the determining factor of how fast the AGC loop can be made at low speed. This transport time consists of the time the strip takes to go from the roll gap of stand $(n-1)$ to the roll gap of stand n, and then from the roll gap of the $n^{th}$ stand to the delivery gauge 14. By far the largest portion of this transport time is the time required for the strip to move from the $(n-1)^{th}$ stand roll gap to the $n^{th}$ stand roll gap (approximately 8 feet), at stand $(n-1)$ speed, as compared with moving from the $n^{th}$ stand roll gap to the delivery gauge (approximately 1.5 feet). Since the speed of the $n^{th}$ stand is substantially equal to that of the $(n-1)^{th}$ stand ($\pm 4\%$), since very little strip reduction is taken on the $n^{th}$ stand, it is assumed the strip is traveling at stand $(n-1)$ speed in moving from the $(n-1)^{th}$ stand roll gap where, as a practical matter, strip gauge corrections are made to the delivery gauge. Of course, at low thread speed, the strip being rolled for a given period of time is approximately 1/20 the same length of strip being rolled at the mill maximum speed (5000 FPM). It is therefore desirable that the AGC loop response become faster as the mill speed is increased in order to maintain strip gauge. This is possible since the transport delay between delivery gauge location and $(n-1)^{th}$ stand decreases directly with an increase in mill speed. At top mill speed, the transport time delay may no longer be the limiting factor in the AGC loop responses. At top mill speed, the next to last stand speed regulator loop response can be the main factor that governs how fast the delivery AGC loop can be operated.

Figure 2:
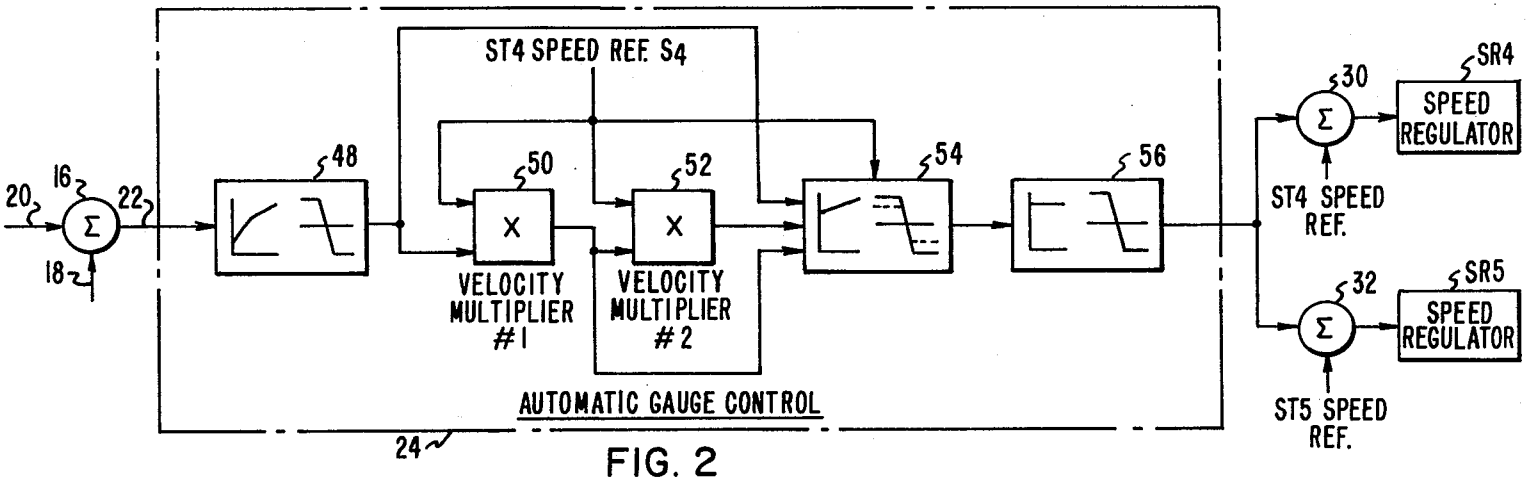
FIG. 2 is a detailed block diagram of the automatic gauge control system of the invention.
Figure 3:
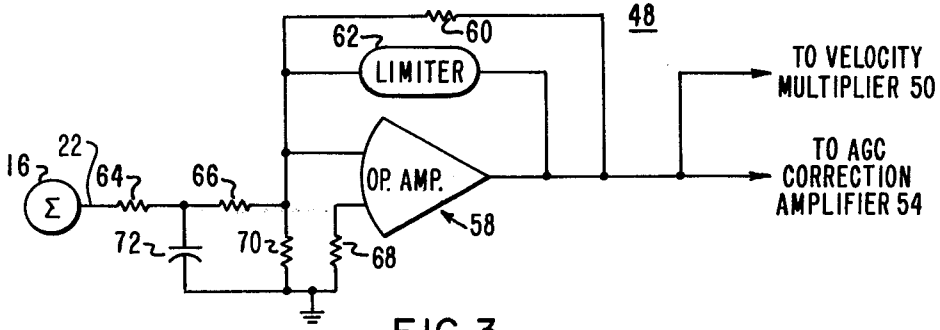
FIG. 3 is a detailed circuit diagram of the error amplifier used in the automatic gauge control system of FIG. 2.

The main components of the automatic gauge control 24 shown in FIG. 2, comprise an error amplifier 48, velocity multiplier #1 identified at 50, velocity multiplier #2, identified at 52, correction amplifier 54 and an inverter 56. The details of the error amplifier 48 and the correction amplifier 54 are shown in FIGS. 3 and 4 respectively.

The actual gauge and the desired gauge reference signals are compared at the summation point 16, as described above, to develop an error signal 22 which is applied to the error amplifier 48. The AGC 24 provides reduced loop gain at low speeds and increased loop gain at high speeds as described in U.S. Pat. No. 3,765,203 cited supra. Briefly, as shown by the transfer characteristic curves within the box, the amplifier 48 will produce an output linear signal which varies above and below a zero reference, depending upon the magnitude and polarity of the input error signal. The error signal is applied to the first velocity multiplier 50 where it is multiplied with the signal S4 (from tachometer FIG. 1:26) which is proportional to the speed of stand ST4. The error signal is also applied directly to the correction amplifier 54, more specifically to the potentiometer K3 (FIG. 4).

Figure 4:
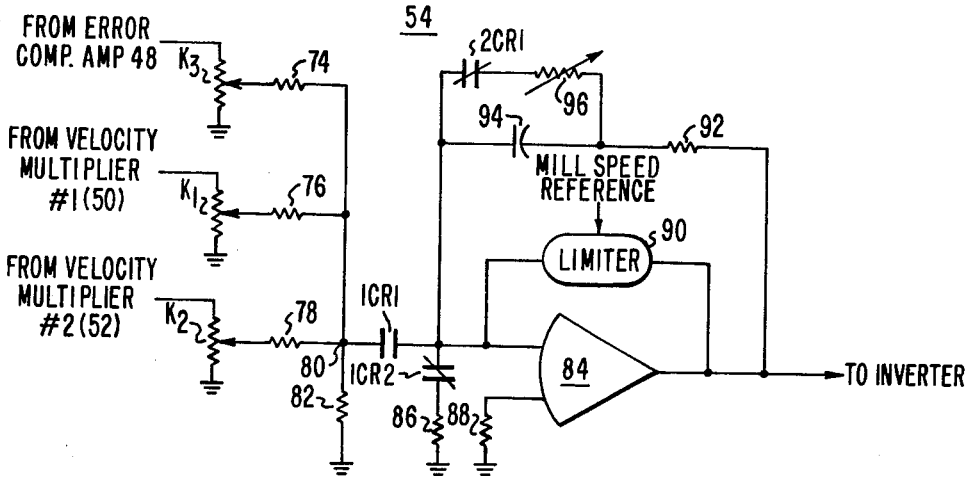
FIG. 4 is a detailed circuit diagram of the correction amplifier used in the automatic gauge control system of FIG. 2.

The output of multiplier 50 is applied directly to potentiometer $K_1$ of correction amplifier 54 (FIG. 4). The output of the multiplier 50 is also applied to velocity multiplier 52 where it is again multiplied with the speed signal S4. Thus the output of multiplier 52 comprises the original gauge deviation signal at the output of error amplifier 48, multiplied by the square of stand ST4 speed i.e. $(S_4)^2$; this signal is then applied to AGC correction amplifier 54 at potentiometer $K_2$ (FIG. 4).

The error amplifier 48 shown in FIG. 3 comprises an operational amplifier shown generally at 58, having dual feedback paths, one having a resistor 60 and the other containing a limiter 62 which limits the maximum output excursion of the operational amplifier above and below the zero reference. The input from the summation point 16 is through serially connected resistors 64 and 66, while another input is through resistor 68 which is returned to ground. The resistor 70 and capacitor 72 are connected between the ends of resistor 62 and ground as shown.

The AGC correction amplifier 54 is shown in FIG. 4. Each of the potentiometers $K_3$, $K_1$ and $K_2$ is provided with a moveable tap connected through resistors 74, 76 and 78 to summation node 80 which is returned to ground through resistor 82.

The operational amplifier indicated generally at 84 is a proportional integral controller. Node 80 is connected to one input of the amplifier 84 through normally open contacts 1CR1. This input to the amplifier 84 is also connected to ground through normally closed contacts 1CR2 and resistor 86. A second input to the amplifier 84 is connected to ground through resistor 88.

The feedback path of amplifier 84 includes a limiter 90 and serially connected resistor 92 and capacitor 94. The capacitor 94 is shunted by serially connected normally closed contacts 2CR1 and trimming resistor 96. The limiter 90 which in response to a function of the stand 4 speed reference, limits the maximum output of the operational amplifier 84. The limiter voltage reaches its maximum value at approximately 3 percent of stand 4 maximum speed and goes to zero linearly as standspeed goes to zero. The limiter 90 prevents the delivery automatic gauge control system from trying to control delivery gauge at very low mill speeds i.e. below 5% maximum speed. At this low speed the gauge is usually too heavy for the system to correct, and the automatic gauge control system might increase the tension between stands 4 and 5 to the point of strip breakage. This contingency is prevented by reducing the allowable output voltage signal of the controller amplifier 84 at very low operating speeds.

The identifications for the relay contacts are as follows. The first numeral identifies the relay number and the numeral following the letters CR (for control relay) designates the particular contacts of the same relay which are under discussion.

Thus 1CR1 and 1CR2 are the first and second contacts of the first contact relay so that when relay 1CR is energized they will be activated with an electrical effect dependent upon their initial normal state of closure.

The multipliers 50 and 52 are static multipliers well known in the art. Similarly the inverter 56 is well known in the art having a function to merely invert the polarity of the incoming signal.

The AGC loop response at low speed i.e. 500 FPM is determined by the potentiometer gain setting $K_1$ (low speed adjustment) (FIG. 4). The commercially available static multipliers 50, 52 (FIG. 2) are inaccurate at low input voltages which occur at very low speed. Therefore potentiometer gain setting $K_3$, which by-passes the AGC velocity multiplier 50 and 52, is used to adjust the AGC loop response at thread speed (300 FPM); if the static multipliers were perfect this gain potentiometer adjustment would not be required. As the speed varies at relatively low speeds, so will the voltage at the tap on the potentiometer $K_1$ to thus automatically vary the gain upwardly or downwardly as speed increases or decreases respectively. At low speeds however, the output from the multiplier 52 will be very small since it comprises the original deviation signal multiplied by the square of the speed $(S_4)^2$. However at higher speed, the output of multiplier 52 becomes appreciably larger and hence, the setting of potentiometer $K_2$ plays an increasingly large role until at high enough speeds it becomes dominant. Again as at low speeds the gain will increase or decrease directly as the speed changes. At all times the signals on the taps of potentiometer $K_1$, $K_2$ and $K_3$ are summed at node 80. Thus, the variation of the AGC controller 84 gain as a function of the square of stand 4 speed automatically adjusts the AGC loop to mill speed changes.

During normal operation, relays 1CR and 2CR are energized. Thus, 1CR1 closes and 1CR1 and 2CR1 open. Therefore, the capacitor 94 can function as an integrator. When the strip has completely passed through the mill the operator deenergizes the AGC by deenergizing 1CR and 2CR. When 2CR1 closes, the integration capacitor 94 discharges through resistor 96. If for any reason, while the strip is still in the mill, if the operator wishes to disengage the AGC, relay 1CR is deenergized: 1CR1 opens and 1CR2 closes. Thus no input signal is applied to amplifier 84 from node 80, and the voltage on capacitor 94 is on hold since 2CR remains energized.

Figure 5:
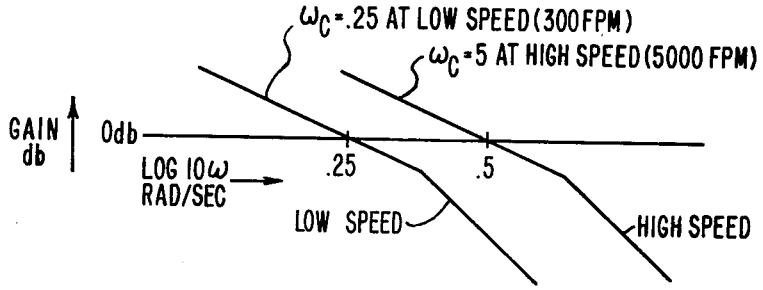
FIG. 5 is an open loop Bode plot depicting rolling speed vs. gain, and illustrating how the AGC loop gain varies as a function of speed.

An open loop Bode plot for the correction amplifier 84 is shown in FIG. 5. The AGC correction amplifier 84 is a P1 controller which contains an integrator insuring zero steady state strip gauge error and a lead time constant which compensates for the major time delay of the next to last stand (ST4) speed regulator loop SR4 which is approximately 0.3 seconds or less. At high mill speed, the secondary time delay (approximately 0.1 second and smaller) of the speed loop which has break frequencies of approximately 10 radians/sec., (see open-loop Bode plot in FIG. 5), in most cases will limit the response of the AGC loop to a cross-over frequency of approximately 5 radians/sec. These speed loop secondary time delays are contributed to the AGC loop by the armature current loop on the last stand. It is important to make these time delays as small as possible by making the speed and armature current loops as fast as possible. At low thread speed (300 FPM), the transport time delay between delivery gauge and ST4, which is approximately 1 second, limits the cross-over frequency of the AGC loop to approximately 0.25 radians/sec.

Although this invention has been described using analog control components, the inventive concept is equally applicable utilizing digital sample control data supplied by a digital computer.

I claim:

1. The method of controlling the final output gauge of strip material passing through a tandem rolling mill including 1, 2, . . . n stands, comprising the steps of: varying the speed of the $(n-1)^{th}$ in relation to an inputted thickness into said $(n-1)^{th}$ stand and to a desired delivery gauge at the output of said $n^{th}$ stand; with said $n^{th}$ stand having rolls which have been sandblasted for effecting rough surfacing treatment of said strip material therethrough; and varying the speed of said $n^{th}$ stand substantially by the same speed percentage as said $(n-1)^{th}$ stand.

2. The method according to claim 1 including the steps of: measuring the gauge of the strip material at the exit of the $n^{th}$ stand, for providing a signal proportional to the actual gauge; comparing said actual gauge signal with a reference gauge signal to derive a gauge deviation signal; modifying said gauge deviation signal as a function of the speed of the $(n-1)^{th}$ stand to derive a first error signal; modifying said first error signal as a function of the speed of the $(n-1)^{th}$ stand to derive a second error signal; said $n^{th}$ stand varying step and said $(n-1)^{th}$ stand varying step being in response to a combined selection of said gauge deviation signal, said second error signal.

3. In a multi-stand rolling mill having an automatic gauge delivery control system for controlling the gauge of a metal strip between a first and a last stand of the mill, the combination of:

rolls having a rough surface mounted on said last stand for effecting surface treatment upon said strip;

with said automatic gauge control system controlling the speeds of the rolls of said last stand and of said next to last stand, through an automatic gauge feedback loop in relation to a delivery gauge sensed after said last stand and to a delivery gauge reference signal;

with control of the speeds of said last stand and next to last stand by said automatic gauge control system being modified in relation to the speed of said next to the last stand;

with said automatic gauge control system being operative to establish a desired delivery gauge by controlling said last stand and the next to the last stand as a unit.

* * * * *